US006253718B1

(12) United States Patent
Uchida et al.

(10) Patent No.: US 6,253,718 B1
(45) Date of Patent: Jul. 3, 2001

(54) EXHAUST CONTROL VALVE ASSEMBLY FOR AN ENGINE

(75) Inventors: Hiroyuki Uchida; Shigeyuki Hara; Tsutomu Fukusho, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/539,716

(22) Filed: Mar. 31, 2000

(30) Foreign Application Priority Data

Mar. 31, 1999 (JP) ..... 11-091371

(51) Int. Cl.[7] ..... F02B 75/02
(52) U.S. Cl. ..... 123/65 PE; 123/323
(58) Field of Search ..... 123/65 PE, 65 V, 123/323

(56) References Cited

FOREIGN PATENT DOCUMENTS 63-306227 12/1988 (JP) .

*Primary Examiner*—Noah P. Kamen
(74) *Attorney, Agent, or Firm*—Birch, Stewart, Kolasch & Birch, LLP

(57) ABSTRACT

An exhaust control valve assembly for a two-cycle engine is formed to effectively dissipate heat. The exhaust control valve includes a pair of valve elements disposed on opposite sides of a reinforcing wall. The reinforcing wall laterally bisects an opening of the exhaust port in a vertical direction. A valve stem is connected to bosses of the valve elements. The valve stem is supported in a rotatable manner by a pouch-shaped hole at one end and a through-hole at its other end. A drive system is coupled to an end part of the valve stem protruding outwards from the through-hole. The whole of the bosses of the valve elements is offset from the center of the reinforcing wall towards the through-hole. This arrangement allows heat, resulting from the exhaust gases passing by the valve elements, to be dissipate without overheating the valve stem on the pouch-shaped hole side.

20 Claims, 7 Drawing Sheets

EXHAUST CONTROL VALVE ASSEMBLY FOR AN ENGINE

BACKGROUND OF THE INVENTION

1. Field of the Invention

The present invention relates to an exhaust control valve assembly for an engine, such as a two-cycle engine.

2. Description of the Relevant Art

In accordance with the background art, an exhaust control valve for a two-cycle engine includes a pair of valve elements. The valve elements are formed symmetrically. The valve elements sandwich a reinforcing wall, which laterally bisects a central section of an opening to a cylinder bore of an exhaust port. Such as arrangement in disclosed, for example, in Japanese Patent Laid-Open Publication No. Sho. 63-306227.

The background art's exhaust control valve suffers drawbacks. When the exhaust control valve is heated up by exhaust gases, while the engine is running, the valve element nearest to a pouch-shaped bearing hole-side tends to overheat. Overheating the valve element on this side reduces that valve element's resistance to heat, which further inclines the valve element to fail.

SUMMARY OF THE INVENTION

The present inventors have discovered the source of the drawback and invented a solution to the drawback. Exhaust heat, received by each valve element, is transmitted to that valve element's boss. The boss, in turn, transmits the heat to the valve stem. Heat in the valve stem propagates along the valve stem and to the ends of the valve stem. One end of the valve stem passes through a bearing through hole and is connected to the drive system for imparting rotation to the valve stem. The one end of the valve stem has relatively good heat dissipation. Another end of the valve stem is captured within the pouch-shaped bearing hole. The another end of the valve stem tends to trap heat.

It is therefore the object of the present invention to provide an exhaust control valve assembly with good attributes for dissipating heat.

It is another object of the present invention to provide an exhaust control valve assembly which dissipates heat in a relatively even manner.

These and other objects of the invention are accomplished by an engine comprising: a cylinder block having a cylinder bore; an exhaust opening at an inner wall of said cylinder bore; an exhaust port connected to said exhaust opening, said exhaust port having a first wall and a second wall; a dividing wall connecting said first wall and said second wall, so as to divide said exhaust port generally along a dividing plane; an exhaust control valve including a first valve element and a second valve element, said first valve element including a first face facing said cylinder bore and a first boss distal to said first face, said second valve element including a second face facing said cylinder bore and a second boss distal to said second face, said first face residing on one side of said dividing wall and said second face residing on another side of said dividing wall; and a valve stem connected to said first boss and said second boss to impart movement to said first boss and said second boss, a first end of said valve stem extending beyond said first boss and being supported for movement at a first location, a second end of said valve stem extending beyond said second boss and being supported for movement at a second location, wherein said first boss is connected to a first length of said valve stem, which passes through said dividing plane of said exhaust port.

Further, these and other objects of the invention are accomplished by an engine comprising: a cylinder block having a cylinder bore; an exhaust opening at an inner wall of said cylinder bore; an exhaust port connected to said exhaust opening, said exhaust port having a first wall and a second wall; a dividing wall connecting said first wall and said second wall, so as to divide said exhaust port generally along a dividing plane; an exhaust control valve including a first valve element and a second valve element, said first valve element including a first face facing said cylinder bore and a first boss distal to said first face, said second valve element including a second face facing said cylinder bore and a second boss distal to said second face, said first face residing on one side of said dividing wall and said second face residing on another side of said dividing wall; and a valve stem connected to said first boss and said second boss to impart movement to said first boss and said second boss, a first end of said valve stem extending beyond said first boss and being supported for movement at a first location, a second end of said valve stem extending beyond said second boss and being supported for movement at a second location, wherein said first boss extends along a first length of said valve stem and said second boss extends along a second length of said valve stem, and a total of said first length and said second length of said valve stem resides closer to said second location, as opposed to closer to said first location.

Moreover, these and other objects of the invention are accomplished by an engine comprising: a cylinder block having a cylinder bore; an exhaust opening at an inner wall of said cylinder bore; an exhaust port connected to said exhaust opening, said exhaust port having a first wall and a second wall; a dividing wall connecting said first wall and said second wall, so as to divide said exhaust port generally along a dividing plane; an exhaust control valve including a first valve element and a second valve element, said first valve element including a first face facing said cylinder bore and a first boss distal to said first face, said second valve element including a second face facing said cylinder bore and a second boss distal to said second face, said first face residing on one side of said dividing wall and said second face residing on another side of said dividing wall; and a valve stem connected to said first boss and said second boss to impart movement to said first boss and said second boss, a first end of said valve stem extending beyond said first boss and being supported for movement at a first location, a second end of said valve stem extending beyond said second boss and being supported for movement at a second location, wherein said dividing wall is located in a central section of said exhaust port and bisects said exhaust port into a first section and a second section which are substantially equal in cross section, said first section being located nearest said first location and said second section being located nearest said second location, said first boss extends along a first length of said valve stem and said second boss extends along a second length of said valve stem, and a total of said first length and said second length of said valve stem resides more in said second section, as opposed to residing more in said first section.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus, are not limitative of the present invention, and wherein.

DETAILED DESCRIPTION OF THE INVENTION

Figure 1:
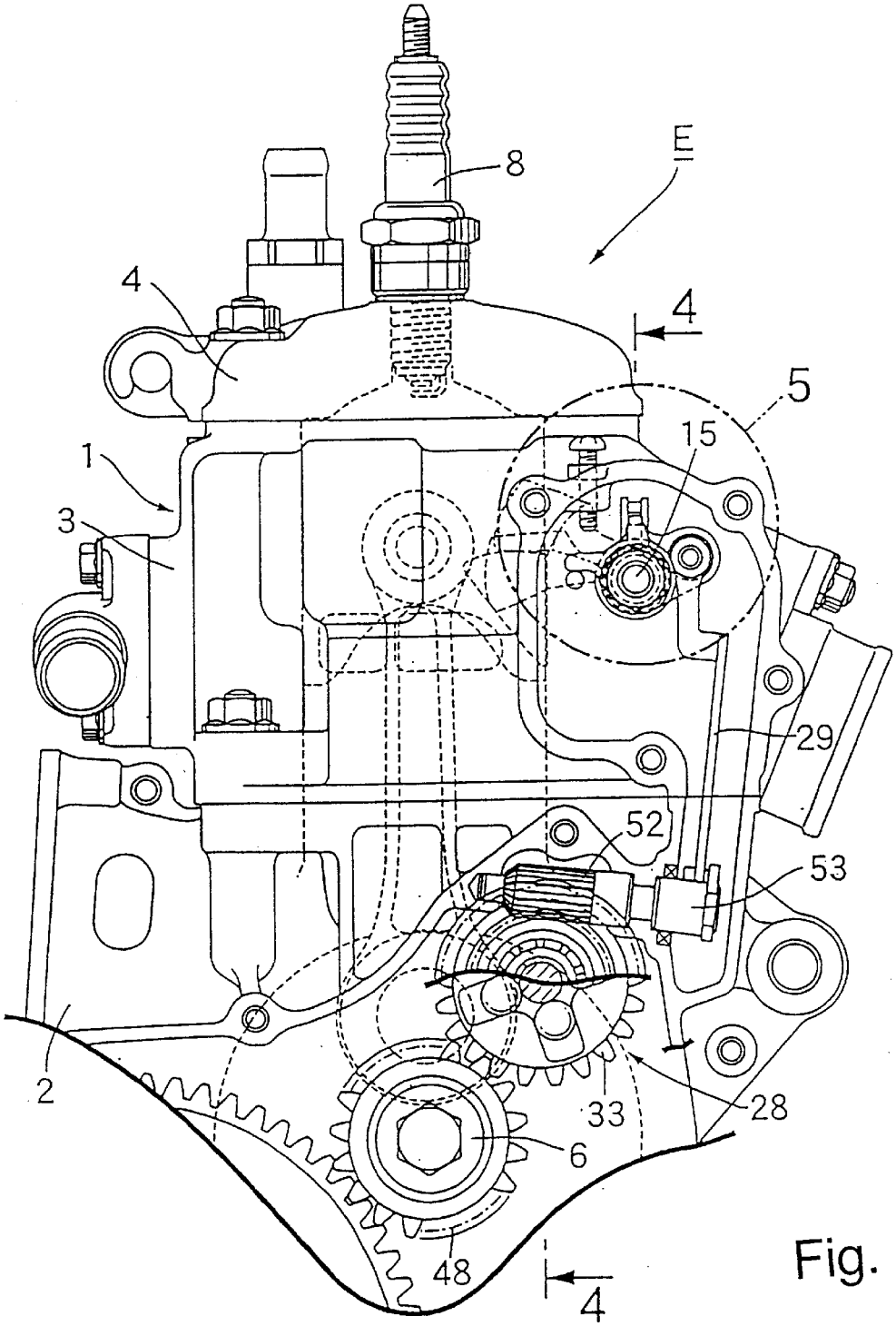
FIG. 1 is a side view of a two-cycle engine, equipped with the exhaust control valve of the present invention.
Figure 2:
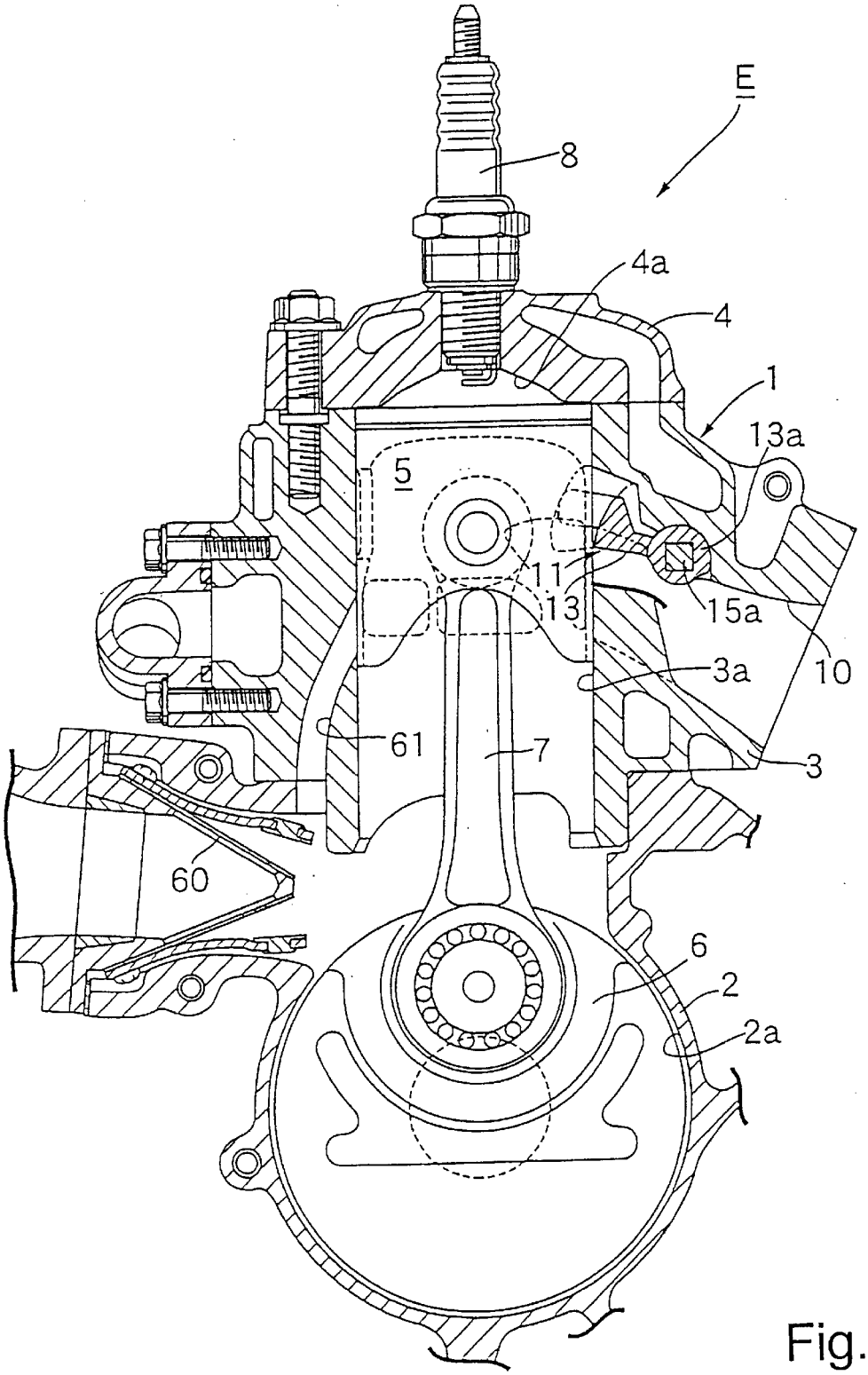
FIG. 2 is a cross-sectional view of the engine of FIG. 1.
Figure 3:
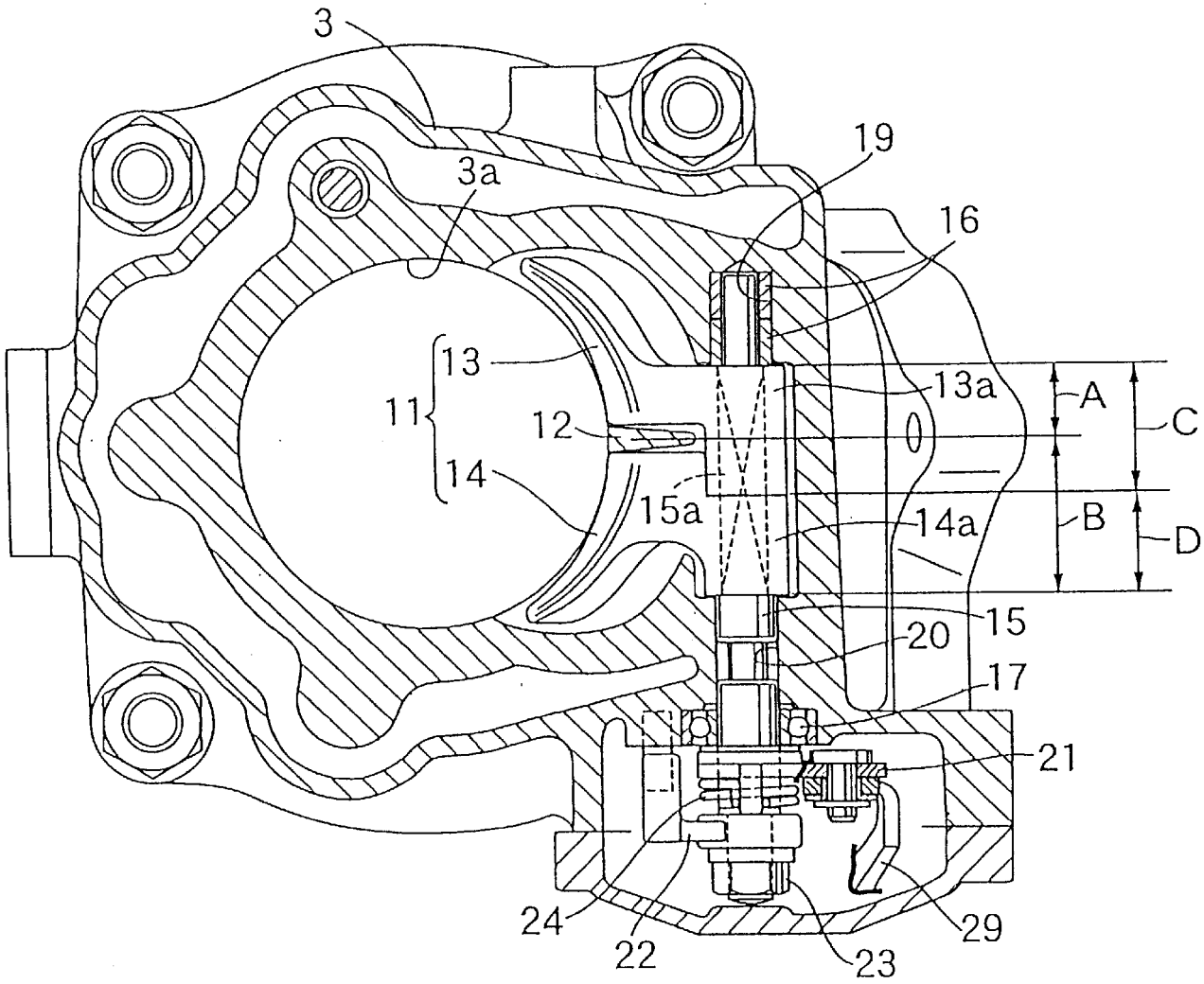
FIG. 3 is a cross-sectional view taken along line 3—3 of FIG. 2.

FIGS. 1–3 illustrate a two-cycle motorcycle engine E, with an engine main body 1. The engine main body 1 includes a crankcase 2, a cylinder block 3 connected to an upper end of the crankcase 2, and a cylinder head 4 connected to an upper end of the cylinder block 3. A piston 5, rising and falling in a cylinder bore 3*a* of the cylinder block 3, is connected to a crankshaft 6 via a connecting rod 7. The crankshaft 6 is housed in and supported by the crankcase 2. One or more spark plugs 8 are then screwed into the cylinder head 4, so that electrodes of the spark plugs 8 face an ignition chamber 4*a*.

An exhaust port 10, opened and closed by the piston 5, is provided in the surrounding wall of the cylinder block 3. An exhaust control valve 11 is arranged at an upper edge of an upstream opening of the exhaust port 10, near the cylinder bore 3*a*. The exhaust control valve 11 exerts control in such a manner as to advance the timing of opening of the exhaust port 10, according to increases in the engine speed. A reinforcing wall 12 is integrally formed with, or alternately attached to, the cylinder block 3. The reinforcing wall 12 laterally bisects a central part of the upstream opening of the exhaust port 10 and connects a first or upper wall and a second or lower wall.

As shown in FIG. 3, the exhaust control valve 11 includes a first valve element 13 and a second valve element 14, arranged so as to sandwich the reinforcing wall 12, and a single valve stem 15. The valve stem 15 is coupled to a first boss 13*a* and a second 14*a* of the first valve element 13 and the second valve element 14, respectively. The end surfaces of the first and second valve elements 13 and 14 are formed as arced surfaces, continuing on from the inner surface of the cylinder bore 3*a*, and the first boss 13*a* and the second boss 14*a* abut from the rear of the reinforcing wall 12.

The valve stem 15 is supported at both ends. One end is supported by a bushing 16. The other end is supported by a ball bearing 17. The bushing 16 and ball bearing 17 are lined up along the same axis of the valve stem. The bushing 16 is fitted into a pouch-shaped bearing hole 19 provided at a sidewall of the cylinder block 3. The ball bearing 17 is fitted into a bearing through-hole 20 at the other sidewall of the cylinder block 3. A central part of the valve stem 15 is formed with angled surfaces 15*a*, such a square cross sectional shape. The first boss 13*a* and the second boss 14*a* of the valve elements 13 and 14 engage with the angled surfaces 15*a* of the valve stem 15, so as to rotate in unison therewith.

Figure 4:
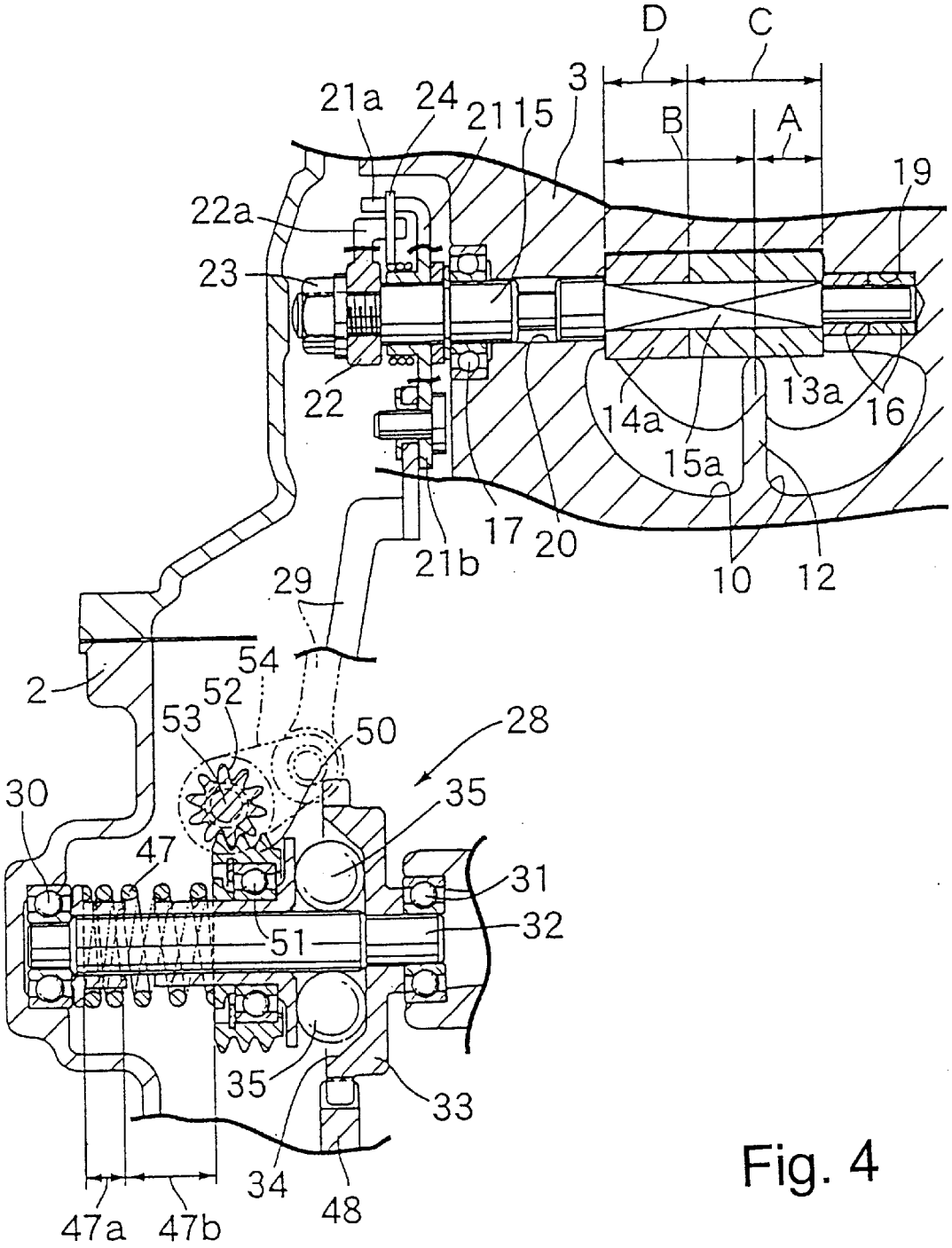
FIG. 4 is a cross-sectional view taken along line 4—4 of FIG. 1.

As shown in FIGS. 3 and 4, rocker valve sections of the first and second valve elements 13 and 14 are formed in a symmetrical manner with respect to the reinforcing wall 12. The first boss 13*a* and the second boss 14*a* of the valve elements 13 and 14 are formed and positioned in a particular manner, in accordance with the present invention. Namely, a first distance (A) represents a distance, in an axial direction of the valve stem 15, from the outer end of the boss 13*a*, on the pouch-shaped bearing hole 19 side, to the center of the reinforcing wall 12. Also, a second distance (B) represents a distance, in the axial direction of the valve stem, from the outer end of the boss 14*a*, on the bearing through hole 20 side, to the center of the reinforcing wall 12. The first distance (A) is set to be less than the second distance (B). As a result, both the first boss 13*a* and the second boss 14*a* are arranged in such a manner as to be offset overall from the reinforcing wall 12 towards the bearing through hole 20 side of the exhaust port 10.

A further aspect of the invention is to define the length of the first boss 13*a* as a first length (C), and to define the length of the second boss 14*a* as a second length (D). The first length (C) is set to be greater than the second length (D). As a result, the thermal capacity of the first boss 13a is larger than the thermal capacity of the second boss 14*a*.

Figure 5:
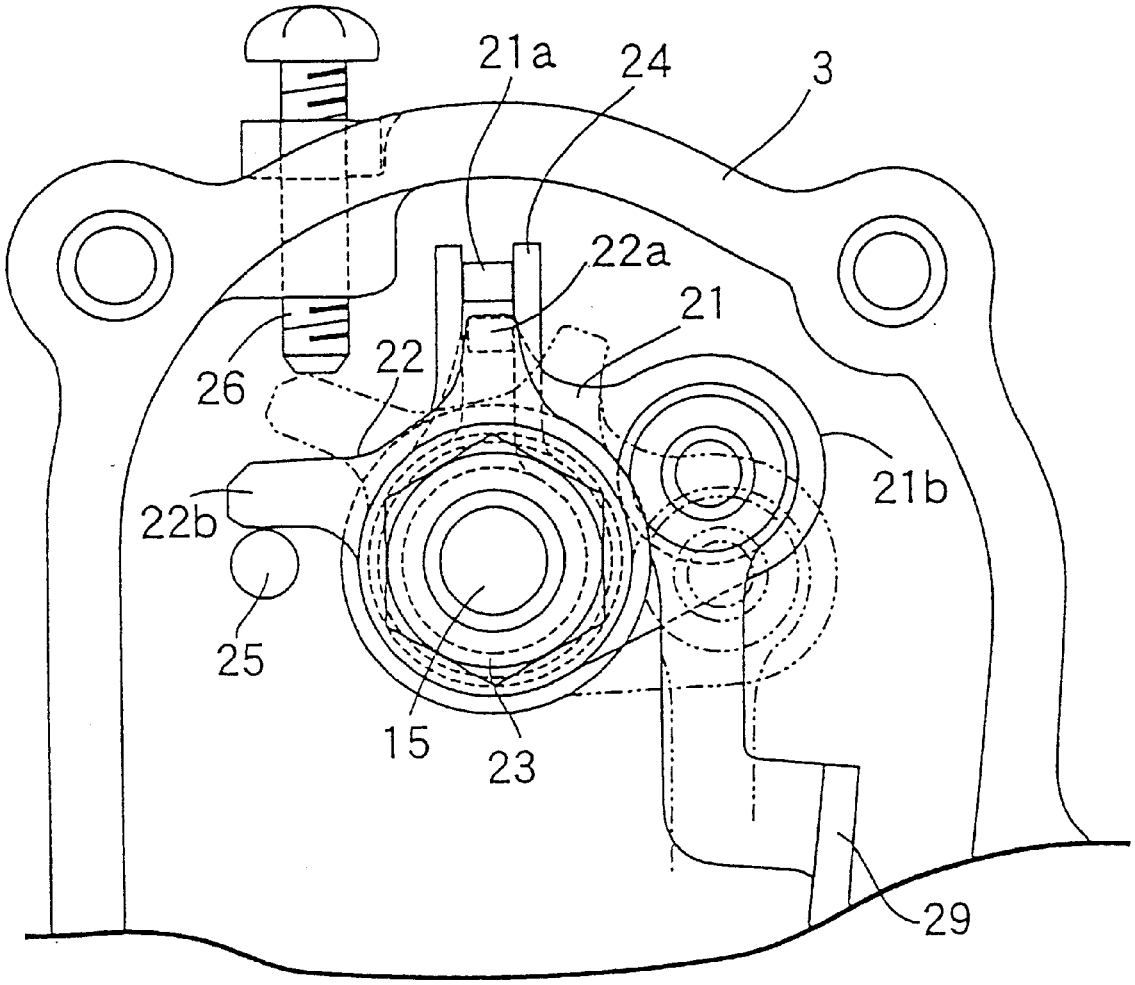
FIG. 5 is an enlarged view of a portion of the engine within a dashed circle 5 of FIG. 1.

As shown in FIGS. 4 and 5, a first driven lever 21 and a second driven lever 22 are attached in a rotatable manner to a second end of the valve stem 15, protruding outwards from the ball bearing 17. The first driven lever 21 and the second driven lever 22 are attached using a nut 23. The first driven lever 21 is equipped with first and second arms 21*a* and 21*b*. The second driven lever 22 is equipped with first and second arms 22*a* and 22*b*. The first arms 21*a* and 22*a* of the first and second driven levers 21 and 22 are coupled by a pincer spring 24. The pincer spring 24 is in the form of a twisted coil fitted at the valve stem 15. The first driven lever 21 therefore rotates the second driven lever 22, via the pincer spring 24, so that the exhaust control valve 11 is vertically opened and closed via the valve stem 15.

A lower limit stopper 25 and an upper limit stopper 26 are arranged opposite each other at a lower surface and upper surface of the second arm 22*b* of the second driven lever 22, respectively. The lower limit stopper 25 and upper limit stopper 26 limit the extent of opening and closing of the exhaust control valve 11. The lower limit stopper 25 stops a lower surface of the second arm 22*b*, so as to define the closed position of the exhaust control valve 11. The upper limit stopper 26 stops an upper surface of the second arm 22*b*, so as to define the open position of the exhaust control valve 11. The pincer spring 24 can also be modified, so that rotation of the second driven lever 22 is allowed to exceed the extent of rotation of the first driven lever 21.

A centrifugal governor 28 is coupled to the second arm 21*a* of the first driven lever 21 via a link 29. The centrifugal governor 28 includes a support shaft 32, supported at the crankcase 2 via a pair of ball bearings 30 and 31; a governor gear 33, fixed to the support shaft 32; a plurality of centrifugal weights 35, arranged about the support shaft 32 at a conical recess 34 formed at the side of the governor gear 33; a slider 36, supported in a freely slidable manner at the support shaft 32, and making contact with the group of centrifugal weights 35 on the opposite side to the governor gear 33; and a governor spring 47, for urging the slider 36 towards the side of the centrifugal weights 35 with a prescribed setting load. A drive gear 48, fixed to the crankshaft 6, meshes with the governor gear 33 to bring about driving.

An annular rack 50 is attached to the slider 36, in a freely rotatable manner, via a ball bearing 51. A pinion shaft 53, having a pinion 52 meshing with the annular rack 50, is supported in a freely rotatable manner at the crankcase 2. A drive lever 54, fixed to an end of the pinion shaft 53, is coupled to the second arm 21*b* of the first driven lever 21 via the link 29. As illustrated in FIG. 4, the governor spring 47 is a single coil spring installed at the outer periphery of the support shaft 32. The governor spring 47 is equipped with a small pitch coil section 47*a* and a large pitch coil section 47*b*. With reference to the above elements, a drive system 59 for driving the valve stem 15 is constituted by the centrifugal governor 28, the pinion shaft 53, the drive lever 54, the link 29, the first driven lever 21, the pincer spring 24, and the second driven lever 22.

During operation, when the engine is running, the governor gear 33 is driven from the drive gear 48 of the crankshaft 6. The centrifugal weights 35 rotate in accompaniment with this rotation, and push outward of the conical surface of the recess 34, due to their centrifugal force. The centrifugal weights 35 try to push the slider 36 towards the side of the governor spring 47.

When the engine is running at low speeds, the setting load of the governor spring 47 is larger than the force the group of centrifugal weights 35 exerts on the slider 36. Because the centrifugal force of the group of centrifugal weights 35 is low, the slider 36 and annular rack 50 are held in the retreated position shown in FIG. 4. In this position, the drive lever 54 is in an advanced position. In the advanced position, the second driven lever 22 is rotated, via the link 29, the first driven lever 21, and the pincer spring 24, to a position whereby contact is made with the lower limit stopper 25. In the advanced position, the exhaust control valve 11 is held in a closed position (downward position). As a result, the timing of opening the exhaust port 10 is the most delayed, and at the time of the exhaust stroke, the blowing of new air into the exhaust port 10 from the combustion chamber 4*a* is severely restricted, whereby stability at low running speeds can be achieved.

When the engine speed increases, the thrust on the slider 36, exerted by of the centrifugal weights 35, is greater than the setting load of the governor spring 47. The thrust moves the slider 36 until the thrust force balances with the increasing load of the governor spring 47. The drive lever 54 moves in unison with the slider 36 from the withdrawn position. The second driven lever 22 rotates upwards, via the link 29, the first driven lever 21, and pincer spring 24. Hence, the exhaust control valve 11 is opened (upward position).

When the engine E reaches a prescribed high-speed running state, the second driven lever 22 is stopped by the upper limit stopper 26, and the exhaust control valve 11 is kept in a completely open state. Scavenging of the ignition chamber 4*a* due to new air at the time of the exhaust stroke can then be carried out effectively. Effective scavenging improves the output performance, when the engine is running at high-speeds. Moreover, the scavenging is increased as needed, since the degree of opening of the exhaust port 10 occurs in response to increases in engine speed.

The pressure within the exhaust port 10 tends to urge the exhaust control valve 11 in an opening direction, as do the centrifugal weights 35. Therefore, both the centrifugal weights 35 and the pressure in the exhaust port 10 tend to compress the governor spring 47. The pressure within the exhaust port 10 increases as the engine speed is increased. Therefore, if the spring constant of the governor spring 47 is constant, when the engine speed increases, the governor spring 47 is compressed more than is necessary due to the influence of the aforementioned exhaust port pressure. If the governor spring 47 is compressed more than is necessary, the exhaust control valve 11 is opened more than is necessary, and the optimum output performance of the engine is not obtained.

Figure 6:
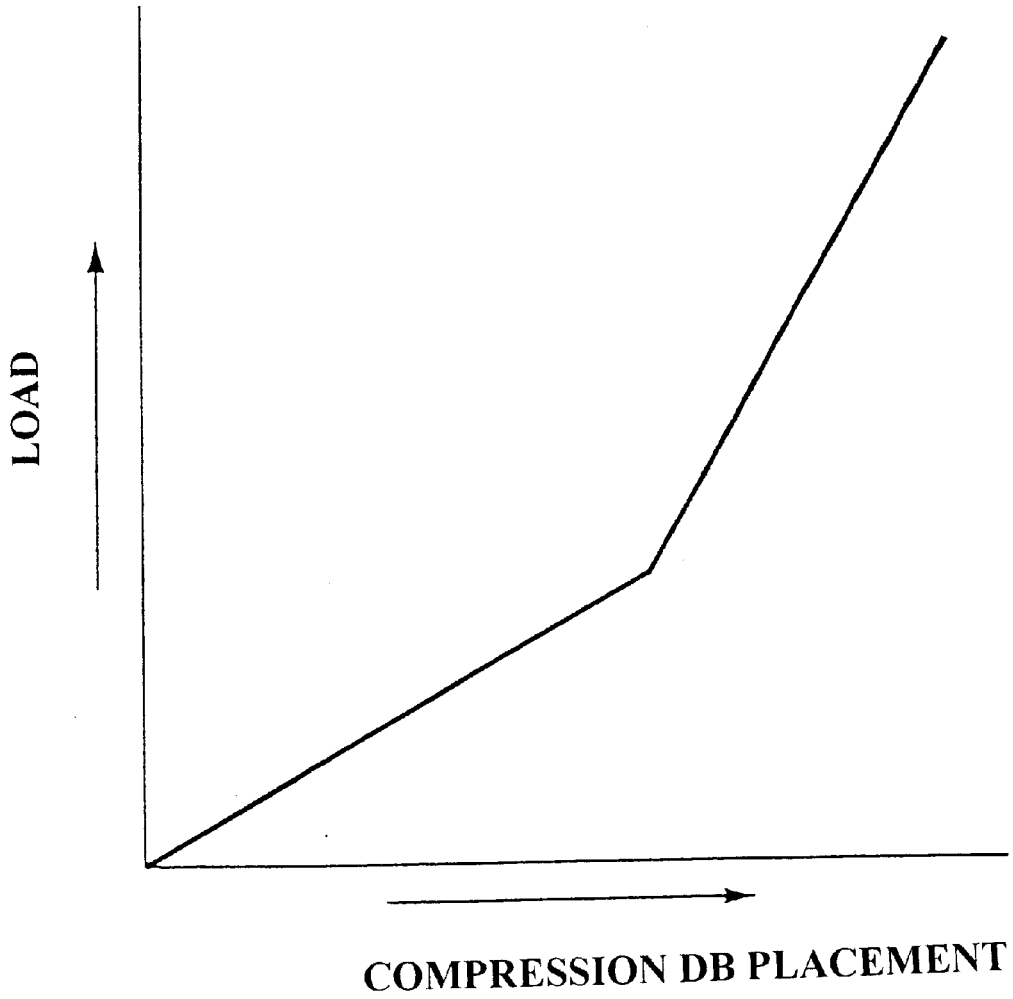
FIG. 6 is a graph of a spring characteristic of a governor spring.
Figure 7:
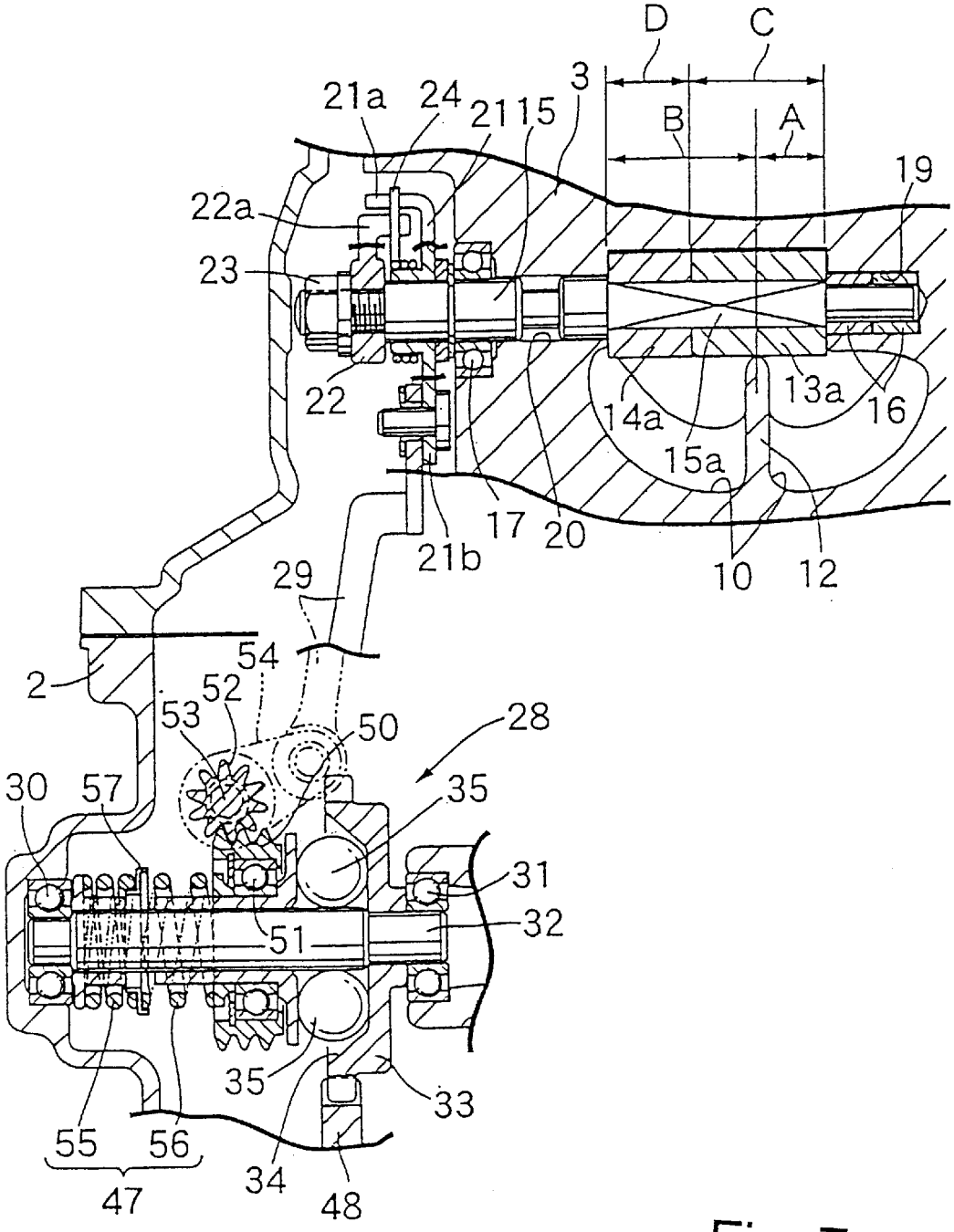
FIG. 7 is a cross-sectional view, similar to FIG. 4, illustrating a modified embodiment of the governor spring.

In the first embodiment of the present invention, the governor spring 47 described above is equipped with a small pitch coil section 47*a* and a large pitch coil section 47*b*. The spring constant of the governor spring 47 is then relatively small when the engine is running at low speed, as shown in FIG. 6. However, when the engine reaches a prescribed high speed, the small spring constant, small pitch coil section 47*a* is compressed into a close contact state, so that just the large pitch coil section 47*b* is operating. When the small pitch coil section 47*a* is compressed, the spring constant of the governor spring 47 becomes large, i.e. the rate of increasing the load with respect to compressive deformation of the governor spring 47 is high. The governor spring 47 is therefore not compressed more than is necessary during high-speed running, even if the pressure within the exhaust port 10 increases. The exhaust control valve 11 can be reliably controlled so as to be opened to an extent corresponding to the high-speed state at this time, and the optimum output performance of the engine can therefore be obtained. It is important to note that the number of parts does not increase, because the governor spring 47 comprises one coil spring, and this contributes towards making the centrifugal governor 28 more compact.

Referring back to the exhaust control valve 11, it is important to note that the exhaust control valve 11 is heated by exhaust gas passing through the exhaust port 10. The heat dissipating ability of the valve stem 15 deteriorates as the side of the bushing 16 is approached. This is because the bush 16 side end of the valve stem 15 is completely covered by the pouch-shaped bearing hole 19, into which the bush 16 is inserted. It is therefore easy for heat to become trapped.

However, in accordance with the present invention, the first and second bosses 13*a* and 14*a* in their entirety are arranged so as to be offset from the reinforcing wall 12, which may pass through the center of the exhaust port 10. The offset is towards the bearing through hole 20, as illustrated in the Figures by setting the distance (A) to be less than the distance (B). The first and second bosses 13*a* and 13*b* are therefore positioned towards the side of the bearing 15 with superior heat dissipation by this offset portion. As a result, the withdrawal of heat from the bosses 13*a* and 14*a* towards the valve bearing 15 is carried out in an effective manner, and the heat dissipating ability of the first and second valve elements 13 and 14 is promoted, as is their resistance to heat.

In addition to the distance (A) being less than the distance (B), by setting the second length (D) less than the first length (C), the thermal capacity of the first boss 13*a* is greater than the thermal capacity of the second boss 14*a*. The withdrawal of heat from the first and second bosses 13*a* and 14*a* to the valve stem 15 is therefore uniform, as is the heat resistance of the first and second valve elements 13 and 14.

The present invention is by no means limited to the aforementioned embodiments, and various design modifications are possible without deviating from the spirit of this invention as laid out in the patent claims. For example, the first and second ends of the valve stem 15 can also be directly supported at the inner surfaces of the pouch-shaped bearing hole 19 and the bearing through-hole 20, respectively. Further, a rolling bearing, such as a needle bearing etc., can be fitted at the pouch-shaped bearing hole 19, instead of the bushing 16. Likewise, a bushing can be fitted at the bearing through-hole 20 in place of the ball bearing 17.

By the present invention, the whole of the first and second bosses for the first and second valve elements is offset from the reinforcing wall towards the side of the drive means, which has superior valve stem heat dissipation. As a result, heat is withdrawn in an effective manner from both bosses to the valve stem, and the heat dissipation of both valve elements is promoted, as is their resistance to heat. Also, by the present invention, the heat capacity of the first boss of the first valve element, on the pouch-shaped bearing hole-side, is set to be larger than that of the second boss of the second valve element on the opposite side. As a result, the withdrawal of heat from both bosses to the valve stem is uniform, and the heat resistance of both valve elements is approximately equal.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine comprising:

a cylinder block having a cylinder bore;

an exhaust opening at an inner wall of said cylinder bore;

an exhaust port connected to said exhaust opening, said exhaust port having a first wall and a second wall;

a dividing wall connecting said first wall and said second wall, so as to divide said exhaust port generally along a dividing plane;

an exhaust control valve including a first valve element and a second valve element, said first valve element including a first face facing said cylinder bore and a first boss distal to said first face, said second valve element including a second face facing said cylinder bore and a second boss distal to said second face, said first face residing on one side of said dividing wall and said second face residing on another side of said dividing wall; and a valve stem connected to said first boss and said second boss to impart movement to said first boss and said second boss, a first end of said valve stem extending beyond said first boss and being supported for movement at a first location, a second end of said valve stem extending beyond said second boss and being supported for movement at a second location, wherein said first boss is connected to a first length of said valve stem, which passes through said dividing plane of said exhaust port.

2. The engine according to claim 1, wherein said first length is longer than said second length.

3. The engine according to claim 1, wherein said first location includes a first hole formed in said cylinder block, said first hole including a receiving end, receiving said first end of said valve stem, and a closed end opposite said receiving end.

4. The engine according to claim 3, wherein a bushing surrounds said valve stem within said first hole.

5. The engine according to claim 1, wherein said second location is formed in said cylinder block and includes a second hole in the form of a through hole, with a portion of said valve stem passing through said second hole.

6. The engine according to claim 5, wherein a bearing surrounds said portion of said valve stem in said second hole.

7. The engine according to claim 5, wherein a drive engages said valve stem adjacent said second end to impart movement to said valve stem.

8. An engine comprising:

a cylinder block having a cylinder bore;

an exhaust opening at an inner wall of said cylinder bore;

an exhaust port connected to said exhaust opening, said exhaust port having a first wall and a second wall;

a dividing wall connecting said first wall and said second wall, so as to divide said exhaust port generally along a dividing plane;

an exhaust control valve including a first valve element and a second valve element, said first valve element including a first face facing said cylinder bore and a first boss distal to said first face, said second valve element including a second face facing said cylinder bore and a second boss distal to said second face, said first face residing on one side of said dividing wall and said second face residing on another side of said dividing wall; and a valve stem connected to said first boss and said second boss to impart movement to said first boss and said second boss, a first end of said valve stem extending beyond said first boss and being supported for movement at a first location, a second end of said valve stem extending beyond said second boss and being supported for movement at a second location, wherein said first boss extends along a first length of said valve stem and said second boss extends along a second length of said valve stem, and a total of said first length and said second length of said valve stem resides closer to said second location, as opposed to closer to said first location.

9. The engine according to claim 8, wherein said first length is longer than said second length.

10. The engine according to claim 8, wherein said first location includes a first hole formed in said cylinder block, said first hole including a receiving end, receiving said first end of said valve stem, and a closed end opposite said receiving end.

11. The engine according to claim 10, wherein a bushing surrounds said valve stem within said first hole.

12. The engine according to claim 8, wherein said second location is formed in said cylinder block and includes a second hole in the form of a through hole, with a portion of said valve stem passing through said second hole.

13. The engine according to claim 12, wherein a bearing surrounds said portion of said valve stem in said second hole.

14. The engine according to claim 12, wherein a drive engages said valve stem adjacent said second end to impart movement to said valve stem.

15. An engine comprising:

a cylinder block having a cylinder bore;

an exhaust opening at an inner wall of said cylinder bore;

an exhaust port connected to said exhaust opening, said exhaust port having a first wall and a second wall;

a dividing wall connecting said first wall and said second wall, so as to divide said exhaust port generally along a dividing plane;

an exhaust control valve including a first valve element and a second valve element, said first valve element including a first face facing said cylinder bore and a first boss distal to said first face, said second valve element including a second face facing said cylinder bore and a second boss distal to said second face, said first face residing on one side of said dividing wall and said second face residing on another side of said dividing wall; and a valve stem connected to said first boss and said second boss to impart movement to said first boss and said second boss, a first end of said valve stem extending beyond said first boss and being supported for movement at a first location, a second end of said valve stem extending beyond said second boss and being supported for movement at a second location, wherein said dividing wall is located in a central section of said exhaust port and bisects said exhaust port into a first section and a second section which are substantially equal in cross section, said first section being located nearest said first location and said second section being located nearest said second location, said first boss extends along a first length of said valve stem and said second boss extends along a second length of said valve stem, and a total of said first length and said second length of said valve stem resides more in said second section, as opposed to residing more in said first section.

16. The engine according to claim 15, wherein said first length is longer than said second length.

17. The engine according to claim 15, wherein said first location includes a first hole formed in said cylinder block, said first hole including a receiving end, receiving said first end of said valve stem, and a closed end opposite said receiving end.

18. The engine according to claim 17, wherein a bushing surrounds said valve stem within said first hole.

19. The engine according to claim 15, wherein said second location is formed in said cylinder block and includes a second hole in the form of a through hole, with a portion of said valve stem passing through said second hole.

20. The engine according to claim 19, wherein a bearing surrounds said portion of said valve stem in said second hole and a drive engages said valve stem adjacent said second end to impart movement to said valve stem.

* * * * *